United States Patent [19]

Schwing

[11] Patent Number: 4,852,467

[45] Date of Patent: Aug. 1, 1989

[54] SPOOL VALVE FOR CONCRETE PUMPS

[75] Inventor: Friedrich Schwing, Gelsenkirchen, Fed. Rep. of Germany

[73] Assignee: Friedrich Wilh. Schwing GmbH, Hern, Fed. Rep. of Germany

[21] Appl. No.: 166,778

[22] Filed: Mar. 7, 1988

Related U.S. Application Data

[63] Continuation of Ser. No. 894,635, Aug. 8, 1986, abandoned.

[30] Foreign Application Priority Data

Aug. 10, 1985 [DE] Fed. Rep. of Germany ..... 3528746

[51] Int. Cl.[4] ..... F01B 29/00; F16J 1/10

[52] U.S. Cl. ..... 92/128; 92/129; 92/168; 251/63.4; 277/187

[58] Field of Search ..... 92/128, 129, 168, 165 R; 251/214, 63.4; 417/516, 531; 277/102, 105, 187

[56] References Cited

U.S. PATENT DOCUMENTS

| | | | |
|---|---|---|---|
| 2,010,129 | 8/1935 | Baker | 92/168 X |
| 2,042,078 | 5/1936 | Suhm et al. | 92/168 X |
| 2,787,126 | 4/1957 | Kleczek | 92/129 X |
| 2,936,996 | 5/1960 | Mercer | 251/214 X |
| 3,070,070 | 12/1962 | Trevor | 92/168 |
| 3,402,592 | 9/1968 | Machon et al. | 92/129 X |
| 3,490,735 | 1/1970 | Nielsen et al. | 251/214 |
| 3,640,303 | 2/1972 | Verheul | 137/238 |
| 4,089,253 | 5/1978 | Visser | 92/168 |
| 4,215,713 | 8/1980 | Kuhlmann | 137/238 |

FOREIGN PATENT DOCUMENTS

| | | |
|---|---|---|
| 1905706 | 2/1970 | Fed. Rep. of Germany . |
| 2700800 | 11/1977 | Fed. Rep. of Germany . |
| 7727633 | 12/1977 | Fed. Rep. of Germany . |

*Primary Examiner*—Robert E. Garrett
*Assistant Examiner*—Mark A. Williamson
*Attorney, Agent, or Firm*—Kinney & Lange

[57] ABSTRACT

In a spool valve for thick matter pumps comprising at least one slide rod running forward and backward which is movable in a guide means and surrounded by a seal, and a drive consisting of working pistons associated with each slide rod, the working pistons each cooperating with one end of the slide rod directed out of a valve casing, and their driving cylinders ending a distance away from the valve casing, the end of the slide rod which runs forward out of the casing being cleaned of adhering thick matter during the backward movement of the piston, the invention provides for the guide means to be disposed on the inside and the seal separate therefrom to be disposed on the outside in front thereof on the valve casing, and for the parts supported loosely on each other in the operative connection between the working piston and the end of the slide rod to provide a gap which is used for assembling and dismounting the seal, the cleaning of the end of the slide rod being effected by the stripping action of the seal.

6 Claims, 2 Drawing Sheets

SPOOL VALVE FOR CONCRETE PUMPS

This is a Continuation of application Ser. No. 894,635, filed Aug. 8, 1986 (now abandoned).

BACKGROUND OF THE INVENTION

1. Field of the Invention

The present invention relates to a spool valve for thick matter pumps according to the introductory part of claim 1.

2. Description of the Prior Art.

The invention relates in particular to thick matter pumps which deliver concrete. The inventive spool valve is suitable for two-cylinder thick matter pumps, whereby two spool valves may be disposed in its valve casing which run forward and backward in push-pull action. Each valve then controls a cylinder of the pump in such a way that said cylinder sucks in the thick matter in one end position of the spool valve and presses it into a feed pipe in the opposite position of the valve. Since the valves generally have the same design as each other, a description of one of these valves suffices.

The forward and backward movement of the valve requires the transfer of kinetic energy in both directions. For this purpose, working pistons are provided which are preferably driven hydraulically by a pressure medium. Both ends of the slide rod are directed out of the casing, which is advantageous, for instance, in that the faces of the slide rod cannot be blocked in the casing with caking thick matter. It is necessary to seal the slide rod in order to retain the liquid component of the thick matter, which is built up with fine particles, in the casing, in which the thick matter is subjected to considerable overpressure under the influence of the pumping process. Since the slide rod cannot be closed off, or at least not completely closed off, in the casing from the thick matter, it leads solid particles outside through the seal during its forward and backward movement. It is therefore necessary to clean the ends of the slide rod protruding out of the valve casing.

The point of departure for the invention is a known spool valve for thick matter pumps (German "auslegeschrift" No. 27 00 800). Herein, the distance between the driving cylinders and the valve casing is used for housing so-called "couplings" which connect the parts of the drive which move back and forth with the ends of the slide rod and are effective in both directions. This leads to outer dimensions which considerably exceed those of the working pistons or the working cylinders. The described operative connections between the working pistons and the slide rod can therefore not be housed in extensions of the working cylinders. However, this is possible in the case of other known spool valves for thick matter pumps which act on both ends of the slide rod with driving cylinders of simple action (German "auslegeschrift" No. 19 05 706). Herein, the cylinders are flanged directly onto the valve casing by the aid of a tubular extension, so that there is a free space between the cylinder face and the valve casing. The tubular extension of the working cylinders takes up the seal disposed outside on the casing and two bushings separate therefrom and adjacent one on the outside and one on the inside as a valve guide means. This creates in the tubular extension between the outer guide bushing and the working piston a cylinder chamber which grows larger and smaller in the rhythm of the working cycles and through which an oil liquid is directed which cleans the slide rod behind the seal.

In the spool valve forming the pint of departure of the invention, however, the seals are disposed in the guide bushes which have flushing chambers through which a flushing liquid also circulates. For it has turned out that fine grain from the thick matter is directed outside between the guide surface of the bushing and the slide rod. In the case of concrete pumps, this is usually so-called cement paste, a substance which also sets under water. The flushing liquid, which usually consists wholly or partly of oil, is supposed to clean the end of the slide rod, i.e. detach and take away the particles which have been carried along. However, the process is not perfect under practical conditions. This leads as a result to small amounts of solids, depending on the type of thick matter, getting into the outer guide means after they have overcome the seal, where they cannot be completely removed. Due to the numerous cycles of movement which the valve must perform during an operation of a thick matter pump, so much solid matter finally collects in the guide means that the slide rod may be blocked, but at least becomes sluggish. In spite of the great efforts for supplying and removing the flushing liquid, the cleaning effect is therefore insufficient.

In so far as the resulting difficulties multiply, the seals and guide means must be replaced. For dismounting and subsequent reassembly, the couplings, as the operative connection between the working piston and the protruding end of the slide rod, must be detached, which constitutes time-consuming work. Only then can the parts surrounding the slide rod be assembled and dismounted through the space between the cylinders and the pump casing. The subsequent reassembly of the couplings means a further considerable delay in completing the maintenance work or repair.

The invention is based on the problem of simplifying the structure of the spool valve and preventing it from being impaired by solids which are carried along by the slide rods.

This problem is solved by the invention with the features of claim 1. Expedient embodiments of the invention are the subject of the subclaims.

SUMMARY OF THE INVENTION

According to the invention, the slide rod guide means is disposed on the inside so that there is no need for a slide rod guide means on the outside. The seal, however, is disposed on the outside so that the solid matter is retained by being stripped off the slide rod but can move through the guide means, on the other hand, and thus not arrest the slide rod. The invention can therefore rely on the stripping action of the seal, which in spite of its imperfection suffices to prevent any great external contamination of the valve casing but does not impair the guide means and can therefore not block or even slow down the slide rod. However, in so far as these amounts of solids produce wear in the seal, the invention takes this into account by the easy replaceability of the seal. This is effected in the space between the cylinder faces and the valve casing and through a gap between the parts lying against each other in the operative connection between the driving piston and the slide rod. It can be opened by simply pushing back the driving piston when the pump is standing still and the cylinder control means is in an appropriate position, thereby creating the possibility of pushing the seal over the slide rod to assemble or dismount it on the casing.

The invention is advantageous in that it dispenses with the flushing which has been generally used up to now, without having to put up with contamination impairing the functioning of the spool valve. In so far as difficulties arise due to fine grain of the thick matter being carried along, they occur at the seal and not at the guide means. However, the seal can be replaced at short notice in the described manner without any trouble. The omission of flushing not only means a saving of the connected technical effort, but also prevents solid particles taken up by the flushing from forming slush in the flushing liquid which may lead to difficulties in other parts of the thick matter pump, e.g. in the hydraulic working medium.

The features of claim 2 result in a simple assembly of the seal, which merely needs to be pushed over the end of the slide rod and screwed on.

The features of claim 3 allow for easy replacement of the guide means. However, the guide means may also consist of a bore in the casing, whose guide surfaces are hardened.

The features of claim 4 allow, on the one hand, for the creation of enough room for assembling and dismounting the seals and/or the guide means and provide, on the other hand, for a reliable mounting of the working cylinders in the pump casing.

The details, further features and other advantages of the invention can be found in the following description of an embodiment with reference to the figures in the drawings. These show:

Figure 1:
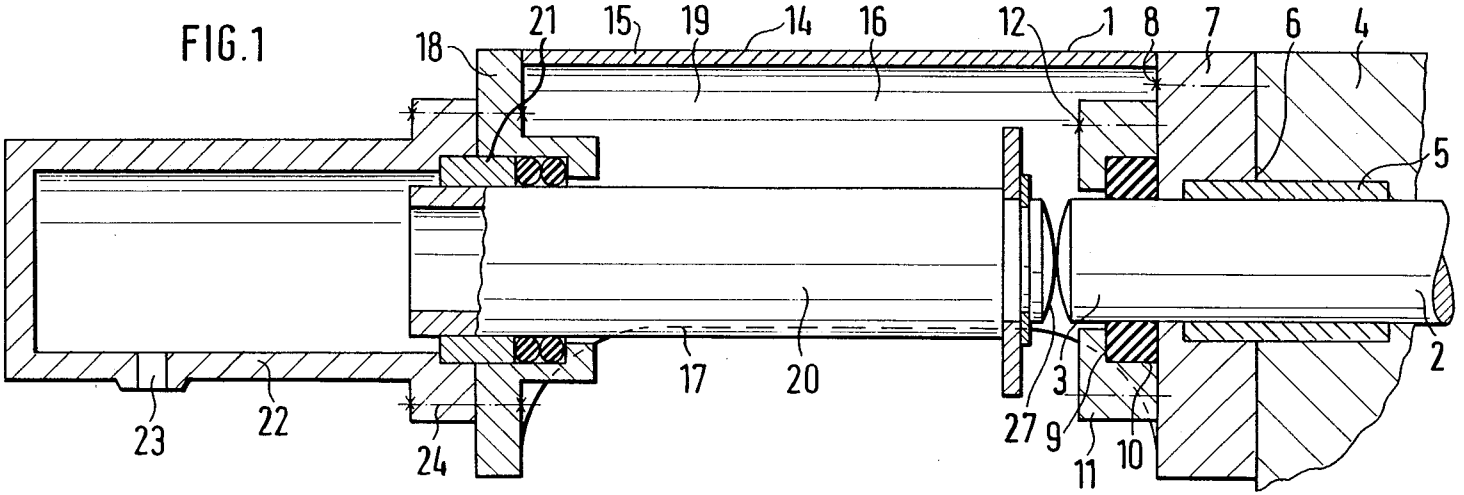
FIG. 1 shows the spool valve for thick matter pumps of the present invention, including an end of the slide rod, the movable and stationary parts of the slide rod casing and of the slide rod drive all cooperating with said end, which are shown partly in cross-section, the operating position being shown and all details not necessary for understanding the invention being omitted.

A spool valve not shown and spool valve 1 corresponding thereto, which is shown, are provided for a two-cylinder reciprocating pump for delivering concrete. The valve plate (not shown) is mounted on a cylindrical slide rod 2 whose outer end 3 is led out of a valve casing 4. The slide rod is seated in a guide bushing and otherwise runs in a cylindrical recess in the casing. Guide bushing 5 is supported with its face in a blind bore 6 in an outer casing plate 7. Plate 7 is screwed to casing 4, as shown for example at 8. The end of the slide rod penetrates a ring seal 9 which is located in a blind bore 10 in a flange 11. Flange 11 is in turn annular and is mounted on casing plate 7 with several screws, one of which is shown for example at 12.

A casing bell 14 is welded to casing plate 7. It consists of a flat or curved cover plate 15 and descending side cheeks 16, a free edge thereof being shown by a dotted line at 17. The free end of the casing bell is welded to an end plate 18 which extends parallel to casing plate 7. Bell 14 is therefore accessible from below.

In the interior 19 of the bell, the outer end of a tubular piston 20 moves. The latter is sealed by a gland 21. It runs in a working cylinder 22 which is subjected to hydraulic working fluid at 23 and is designed to be of simple action. The working cylinder is screwed to plate 18 of bell 14 with several screws 24 disposed in a circle.

Figure 2:
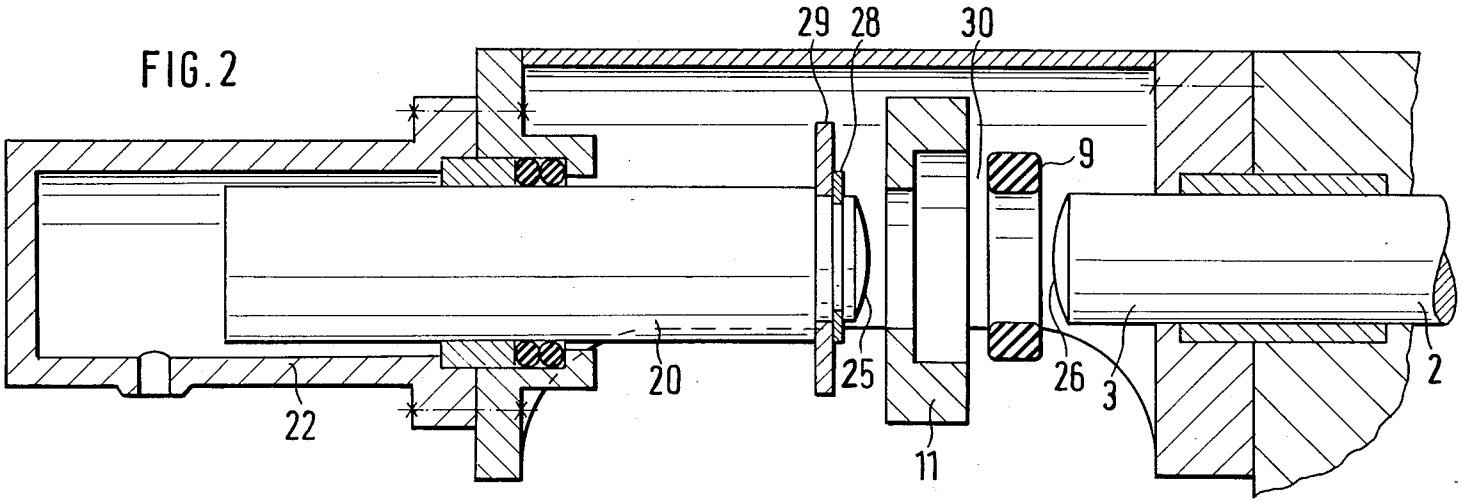
FIG. 2 shows the spool valve for thick matter pumps of the present invention, including the parts during the assembly of the seal, in the view according to FIG. 1.

As can be seen in particular in the view of FIG. 2, the front end of the tubular piston is closed and provided with a dome-shaped bearing 25. The latter forms with dome-shaped end 26 an operative connection 27, which is shown in a closed state in FIG. 1.

Behind dome-shaped bearing 25 of tubular piston 20 there is a spring ring 28 which retains an annular protective disk 29 on the front end of the piston. Protective disk 29 serves as a splash guard which keeps the surface of tubular piston 20 free from solid matter which might leak out of seal 9 unexpectedly.

The state according to FIG. 2 can be achieved by pushing back tubular piston 20 by hand when the control valves of working cylinder 22 are in the appropriate position. This is possible because the tubular piston can be reached through the lower opening of bell 14. After screwed connection 12 has been undone, flange 11 can be removed together with ring seal 9 by being pulled off over end 3 of slide rod 2. The assembly of seal 9 can be performed in the opposite way.

In operation, the pressure medium penetrating working cylinder 22 causes tubular piston 20 to move toward the right according to the view of FIG. 1 until dome-shaped surfaces 25 and 26 lie against each other. The slide rod is then pushed toward the right into its end position, which is shown in FIG. 1.

By changing over cylinder 22 and acting upon the tubular piston not shown which activates the other end of slide rod 2, the opposite movement is initiated, which terminates in the left-hand end position of tubular piston 20. The slide rod thus performs a forward and backward movement so that guide means 5 is disposed on the inside and seal 9 separate therefrom is disposed on the outside in front thereof on valve casing 4. In the position shown in FIG. 2, a gap 30, which is exploited for assembly and dismounting purposes, is located between dome-shaped surfaces 25 and 26.

Figure 3:
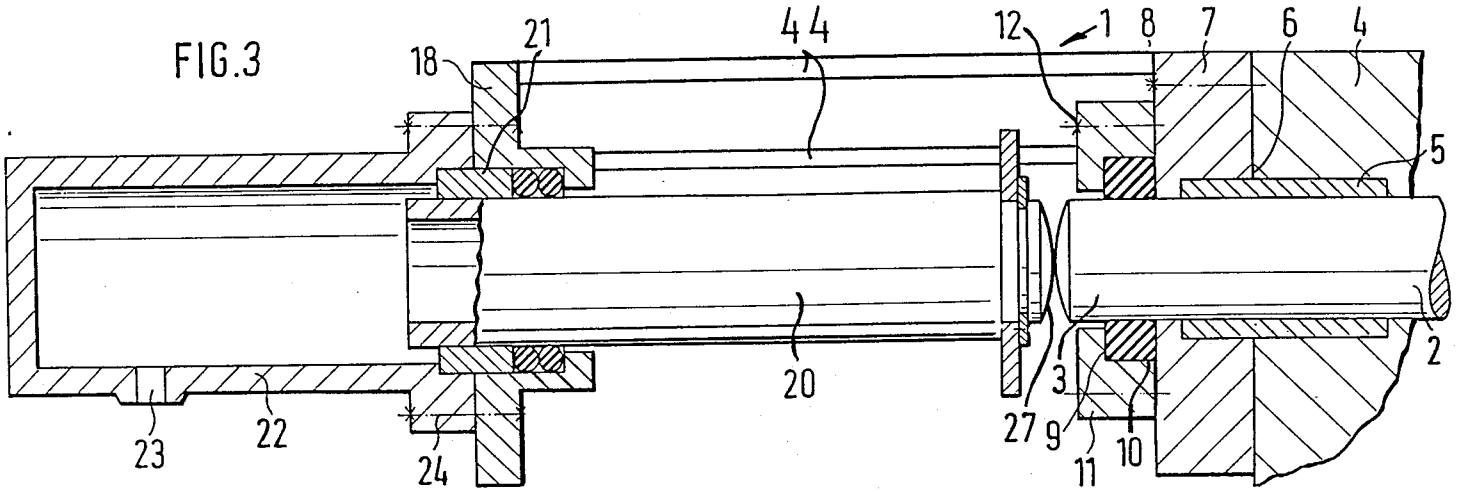
FIG. 3 shows another embodiment for the spool valve for thick matter pumps of the present invention, replacing the casing bell with tie rods, in the view according to FIG. 1.

Instead of bell 14, tie rods 44, 44 can be provided for mounting the working cylinders on valve casing 4 (see FIG. 3).

I claim:

1. In a pump for pumping concrete which has a spool valve for controlling the flow of concrete and wherein the concrete has a number of fine particles therein, the spool valve having a valve casing (4), at least one slide rod (2) mounted for reciprocal axial movement in the valve casing (4) to control the flow of concrete therethrough with each outer end (3) of the slide rod (2) extending out of the valve casing (4), guide bushing means (5) within the valve casing (4) for supporting the slide rod (2) adjacent each outer end (3) thereof, drive means for alternatively pushing on each outer end (3) of the slide rod (2) which includes, for each outer end (3) of the slide rod (2), a driving cylinder (22) and an associated working piston (20) reciprocally mounted therein with the piston (20) aligned for selective axial engagement of a distal end (27) thereof with its respective outer end (3) of the slide rod (2), the improvement which comprises:

annular slide rod seal means (9) retained on an outer surface of the valve casing (4) and surrounding the slide rod (2) proximate each outer end (3) thereof for limiting the escape of fine particles of concrete out of the valve casing (4) along the slide rod (2) as the slide rod (2) is pushed out of the valve casing (4) and for cleaning any fine particles of concrete which have escaped off of the slide rod (2) as the slide rod (2) is pushed back into the valve casing (4) thereby preventing a buildup of concrete along the slide rod (2) at the guide bushing means (5) within the valve casing 4;

each outer end (3) of the slide rod (2) and its respective distal end (27) of the piston (20) axially and loosely abutting in operative connection with the piston (20) being retractable within its driving cylinder (22) to create an axial separation between the outer end (3) of the slide rod (2) and the distal end (27) of the piston (20) of size to permit insertion and removal of the annular slide rod seal means (9) over the outer end (3) of the slide rod (2); and the outer end (3) of the slide rod (2) and the distal end (27) of the piston (20) being freely accessible from outside the spool valve on at least one side thereof and at all positions of abutting operative connection of the slide rod (2) and piston (20).

2. The improved concrete pump spool valve of claim 1 wherein the annular slide rod seal means (9) is a ring seal retained within a blind bore of a flange (11) fixedly mounted to the valve casing (4).

3. The improved concrete pump spool valve of claim 1 wherein the driving cylinder (22) is fixedly mounted to the valve casing (4) by a bell (14) open on one side.

4. The improved concrete pump spool valve of claim 3 wherein the open side of side of the bell (14) is oriented downwardly with the ends (27, 3) of the piston (20) and slide rod (2) disposed in the bell's interior (19).

5. The improved concrete pump spool valve of claim 1 wherein the driving cylinder (22) is fixedly mounted to the valve casing (4) by tie rods (44).

6. A method for reconstructing a pump for pumping concrete includes the replacement of an annular slide rod seal on a spool valve for the concrete pump wherein the spool valve has a valve casing, at least one slide rod mounted for reciprocal axial movement in the valve casing to control the flow of concrete therethrough with each outer end of the slide rod extending out of the valve casing, drive means for alternatively pushing on each outer end of the slide rod which includes, for each outer end of the slide rod, a driving cylinder and an associated working piston reciprocally mounted therein with the piston aligned for selective axial engagement of a distal end thereof with its respective outer end of the slide rod, the method including the steps of:

separating the distal end of the piston from its respective outer end of the slide rod to form an axial gap therebetween;

removing means for retaining a worn annular slide rod seal on an outside surface of the valve casing from the valve casing, the worn seal being coaxially mounted about the slide rod;

sliding the worn seal axially along the slide rod in direction away from the valve casing, past the outer end of the slide rod and into the gap between the ends of the slide rod and piston;

withdrawing the worn seal laterally from coaxial relation with respect to the slide rod through the gap;

inserting a replacement annular slide rod seal laterally into coaxial relation with respect to the slide rod through the gap;

sliding the replacement seal over the outer end of the slide rod, along the slide rod in direction toward the valve casing and into an abutting relation with the outer surface of the valve casing; and replacing the means for retaining onto the valve casing whereby the replacement seal is fixed in coaxial position about the slide rod.

* * * * *